United States Patent [19]

Keil et al.

[11] Patent Number: 4,732,432

[45] Date of Patent: Mar. 22, 1988

[54] BREAKER STRIP FOR A REFRIGERATOR CABINET

[75] Inventors: John P. Keil, Ohio Township, Warrick County; George W. Sisk, Center Township, Vanderburgh County; Glenn E. Katterhenry, Knight Township, Vanderburgh County; Walter H. Schentrup, Perry Township, Vanderburgh County, all of Ind.

[73] Assignee: Whirlpool Corporation, Benton Harbor, Mich.

[21] Appl. No.: 946,931

[22] Filed: Dec. 29, 1986

[51] Int. Cl.[4] ..... B65D 25/18

[52] U.S. Cl. ..... 312/214; 312/296; 220/432

[58] Field of Search ..... 312/214, 296; 220/431, 220/432

[56] References Cited

U.S. PATENT DOCUMENTS

| | | | |
|---|---|---|---|
| 2,368,542 | 1/1945 | Hall . | |
| 2,644,607 | 7/1953 | Hinkel . | |
| 2,723,896 | 11/1955 | Wurtz . | |
| 2,751,106 | 6/1956 | Schrader . | |
| 2,758,741 | 8/1956 | Saunders | 312/214 |
| 2,789,720 | 4/1957 | Palmer . | |
| 2,845,321 | 7/1958 | Saunders et al. . | |
| 2,866,675 | 12/1958 | Kesling . | |
| 2,914,819 | 12/1959 | Janos . | |
| 3,074,522 | 1/1963 | Swick | 220/432 |
| 3,078,003 | 2/1963 | Kesling . | |
| 3,129,837 | 4/1964 | Dawley | 220/432 |
| 3,157,306 | 11/1964 | Courson . | |
| 3,380,615 | 4/1968 | Kessler . | |
| 3,401,815 | 9/1968 | Kesling | 220/434 |
| 3,461,610 | 8/1969 | Peters et al. . | |
| 3,489,477 | 1/1970 | Harder, Jr. . | |
| 3,512,323 | 5/1970 | Hupfer . | |
| 3,622,215 | 11/1971 | Roberts . | |
| 3,633,783 | 12/1971 | Aue . | |
| 3,768,687 | 10/1973 | Spencer | 220/431 |
| 4,099,812 | 7/1978 | Morphy . | |
| 4,653,819 | 3/1987 | Swerbinsky | 312/214 |

FOREIGN PATENT DOCUMENTS

| | | | |
|---|---|---|---|
| 683739 | 12/1952 | United Kingdom | 312/214 |

*Primary Examiner*—Victor N. Sakran

*Attorney, Agent, or Firm*—Wood, Dalton, Phillips, Mason & Rowe

[57] ABSTRACT

A resinous plastic breaker strip for a built-in refrigerator/freezer provides a substantially seamless front face therefor. The breaker strip includes a front portion defining a front face and a rearwardly extending sidewall portion fitted to the liner. A number of spacers partially secure a liner to a rigid frame that extends around the door openings. In-situ formed urethane foam provides the remainder of the rigidity and strength to the cabinet. The breaker strip front portion is spaced forwardly of the frame member. An elongated magnet is disposed between the breaker strip and the frame to magnetically attract the door gasket magnet. In a preferred embodiment an odd number of alternating magnet poles are aligned with the axis of elongation of the magnets and the poles of the stationary cabinet magnet are opposite those of the door gasket magnet. The seamless breaker strip provides a non-metallic door sealing surface which reduces heat transfer and condensation on the outer front face of the cabinet.

18 Claims, 4 Drawing Figures

BREAKER STRIP FOR A REFRIGERATOR CABINET

BACKGROUND OF THE INVENTION

1. Field of the Invention

This invention relates generally to refrigerator cabinets, and more particularly, to an improved cabinet wall structure to provide a seamless front face for a refrigerator cabinet.

2. Description of Background Art

Conventional refrigerators include an outer shell and an inner liner, with a breaker strip disposed therebetween to act as a heat-break. Typically, the outer shell includes a forward marginal edge which turns inwardly to act as a flange for magnetic attraction to the magnetic door gasket with the breaker strip being secured within a rolled portion of the flange. If a refrigerator door is in an opened position, a seam is apparent where the breaker strip meets the outer shell. Such an arrangement is shown in Palmer U.S. Pat. No. 2,789,720. The seam may be undesirable from an appearance standpoint.

The outer shell of known refrigerator cabinets is typically of steel or sheet metal construction. The front marginal edge therefore provides a metallic surface on which a magnetic door gasket seals against. Accordingly, a seamless front face may be achieved by further extending inwardly the front marginal edge of the outer shell. Such a construction is shown in Kesling U.S. Pat. No. 3,078,003.

The use of the outer shell to provide a seamless front face aggravates a condition known known as "sweating." When a portion of the outer shell extends internally to the refrigerator cabinet, condensation is more likely to build up on this front face. Therefore, it is necessary to utilize "anti-sweat" heating elements disposed rearwardly of the front face to minimize such condensation. These heating elements increase the cost of the refrigerator both from a manufacturing standpoint and an operational standpoint. With the high cost of energy, it is desirable to minimize the necessity of such heaters.

The present invention overcomes the above problems of prior refrigerator cabinets, in a novel and simple manner.

SUMMARY OF THE INVENTION

In accordance with the present invention, a refrigeration apparatus cabinet is provided with a breaker strip which provides a seamless front face for the cabinet.

Broadly, there is disclosed herein a novel breaker strip for a refrigeration apparatus cabinet which extends between a front edge portion of an outer wall and an inner liner. The breaker strip includes a front portion defining a front face of the cabinet, disposed forwardly of the front edge portion of the outer wall. The breaker strip also includes a rearwardly extending inner turned portion which is secured to the liner to provide a seamless front face for the cabinet.

The refrigeration apparatus includes an outer shell having top, bottom and first and second side outer walls. Each said outer wall defines a front edge portion. A liner fits within the outer shell and is spaced from each of the outer walls. A frame structure is provided around the front periphery of the cabinet to add rigidity thereto. The frame is spot welded to the outer walls. A plurality of spacers which, in the preferred embodiment are made of resinous plastic material, are provided to loosely receive a channel portion of the liner to help maintain the liner in spaced relation with the frame, and thus the outer walls. The breaker strip is made of resinous plastic and extends between the outer wall and the liner around all four above-mentioned walls. The breaker strip includes a front portion disposed forwardly of the front edge portion of the outer wall defining a seamless front face for the cabinet. The front portion of the breaker strip is spaced from the frame to prevent moisture condensation on the metal frame. The breaker strip also includes a rearwardly extending inner turned portion which is loosely secured tothe liner. The spacers and the breaker strip retain the liner in spaced relationship to the outer shell during an in-situ foam insulating process, which takes place with the cabinet front facing upwardly. After the insulating process the cabinet is fixedly secured by the spacers tying the liner to the frame and by the foam adhering to the liner and the rearwardly extending portion of the breaker strip.

An elongated magnet extends around the periphery of the cabinet in a space between the breaker strip front portion and the frame to attach the door gasket magnet.

In one embodiment, the magnet is attached to the frame and a pair of rearwardly extending hook members engage a pair of ribs in the magnet to secure the breaker strip to the frame. In a preferred embodiment, the elongated cabinet-mounted magnet and door magnet each have an odd number of alternating poles extending the full length of the magnet. The poles on one magnet are opposite the poles of the other magnet. In this structure, it is not possible to install a magnet backward which would have the effect of attempting to align like poles.

The liner is coupled to the frame with a plurality of plastic spacers. The spacers are screwed or riveted to the frame and are loosely fitted into a turned portion at a front edge of the liner. In-situ insulation foam fills the space between the liner and the outer shell and provides rigidity to the structure by adhering to the shell, frame and liner.

In a refrigerator/freezer having a freezer and a fresh food compartment, a pair of liners are disposed within the outer walls of the cabinet. An additional breaker strip portion is provided to extend between inner front edges of each of the two liners. This additional breaker strip portion includes a front portion defining a front face of a divider wall of said cabinet, and first and second rearwardly extending inner turned portions secured to the freezer compartment liner and a fresh food compartment liner, respectively.

Further features and advantages of the invention will readily be apparent from the specification and from the drawings.

DETAILED DESCRIPTION OF THE PREFERRED EMBODIMENT

Figure 1:
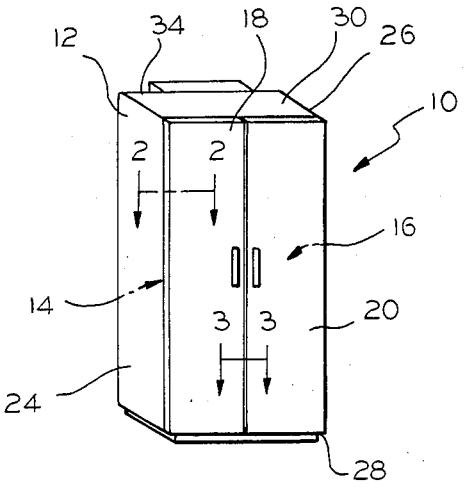
FIG. 1 is a front elevation of a refrigerator/freezer having a breaker strip embodying the invention.

Referring to FIG. 1, a refrigeration apparatus, such as a refrigerator/freezer, 10 includes a breaker strip according to the present invention. The invention is shown utilized with a built-in side-by-side refrigerator/-freezer; however, other types of refrigeration apparatus may be used in conjunction with the breaker strip of the present invention, as will be obvious to those skilled in the art.

The refrigerator/freezer 10 includes a cabinet 12 provided with an insulating separator or divider wall, (not shown) defining a below-freezing, or freezer compartment 14 and a fresh food, or above-freezing compartment 16. A freezer door 18 and a fresh food door 20 are provided for selective access to the freezer and fresh food compartments 14, 16, respectively.

The cabinet 12 includes first and second sidewalls 24, 26, a bottom wall 28 which is part of a base assembly (not shown) and a top wall 30 defining an outer shell.

Figure 2:
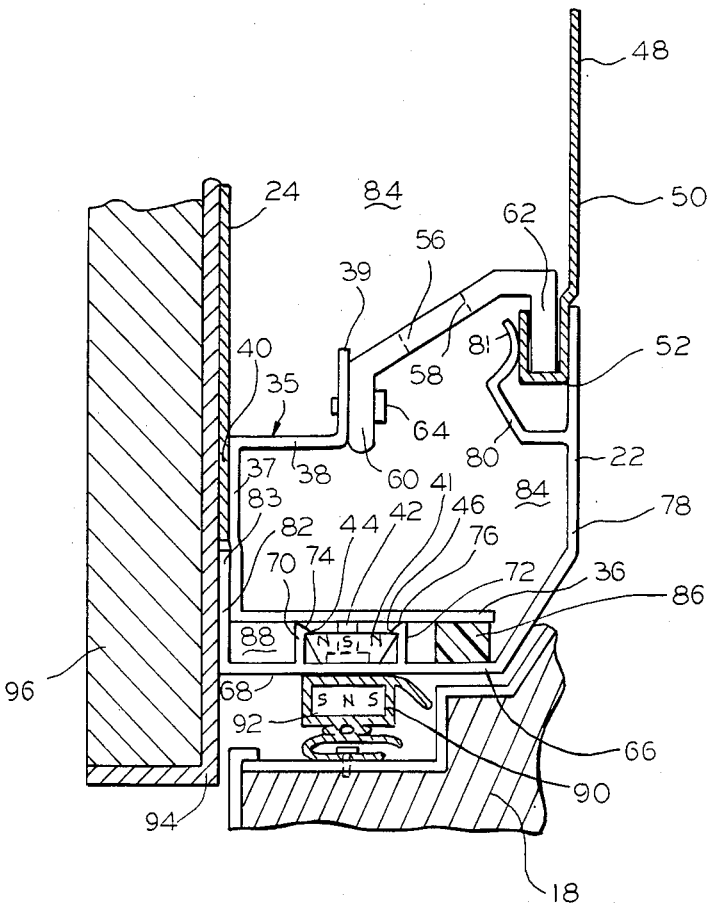
FIG. 2 is a sectional view taken along lines 2—2 of FIG. 1.

A portion of the cabinet 12 along the first outer sidewall 24 embodying a breaker strip 22 of the invention is illustrated in greater detail in FIG. 2. Although not shown, the cabinet construction along the second sidewall 26 and the top and bottom walls 26, 28 are similar to that shown in FIG. 2 as will be obvious to those skilled in the art.

A channel frame 35 provides a support structure for the cabinet 12. The channel frame 35 includes a front portion 36, a rearwardly turned side portion 37, substantially parallel to the sidewall 24, an inwardly extending central portion 38 and a rearwardly turned flange portion 39 in a substantially parallel plane to the plane of the side portion 37. The frame 35 is of steel construction. A front edge portion 40 of the first outer wall 24 is secured by, for example, spot welding it to the side portion 37 of the frame 35. The frame 36 extends up the full extent of the first outer wall 24. An elongated trapezoid-shaped magnet 41 having an odd number of alternating poles is secured to the front portion 36 of the frame 35 with, for example, screws or rivets 42. Alternatively, an appropriate adhesive could be utilized to secure the magnet 41 to the frame 35. The magnet 41 includes first and second ribs 44, 46 in its opposite sidewalls.

An inner liner 48 is disposed within and spaced from each wall 24, 26, 28, 30 and 34 of the shell. A front portion 50 of the liner 48 comprises a turned end channel portion 52. A plurality of molded plastic spacers 56 are disposed between the flange portion 39 of the frame 35 and the liner 48. The spacer is preferably made of resinous plastic material. The spacers 56 includes a central portion angularly disposed between the outer wall 24 and the liner 48, having apertures 58 formed therein. Spacer 56 also includes a first forwardly extending wall 60 and a second forwardly extending wall 62. Apertures are provided in the first forwardly extending wall 60 so that the spacer 56 may be secured to the flange portion 39 of the frame 35 utilizing screws 64 or any other suitable securing devices. The second forwardly extending wall 62 of the spacer 56 is loosely received within the channel portion 52 of the liner 48 to partially maintain the liner 48 in spaced relation with the outer wall 24.

The breaker strip 22 extends between the front edge portion 40 of the outer wall 24 and the front portion 50 of the liner 48. The breaker strip 22 is extruded and is made of a resinous plastic, and includes a front portion 66 defining a front face 68. The front portion 66 is spaced outwardly from the portion 36 at the frame 35 to prevent moisture condensation on the frame 35. A pair of oppositely facing hook members 70, 72 extend rearwardly from the front portion 66. Each said hook member 70, 72 includes a locking ridge 74, 76, respectively. When the breaker strip is positioned with the hook members 70, 72 disposed forwardly at the magnet 41 and a force is applied to the breaker strip 22, the ridges 74, 76 engage the ribs 44, 46, respectively of the magnet 41 to retain the breaker strip 22 thereon and thereby secure the breaker strip 22 to the frame 35.

The breaker strip 22 includes a rearwardly extending inner turned portion 78 including a bifurcated end portion 80 loosely and resiliently embracing the front turned edge portion 50 of the liner 48. The bifurcated end portion 80 includes a finger portion 81. The breaker strip 22 also includes a rearwardly extending outer turned portion 82 having a distal portion 83 disposed forwardly of the front edge portion 40 of the outer wall 24. The front face 68 of the breaker strip 22 is similarly disposed forwardly of the front edge portion 40 of the outer wall 24 and to the front edge 50 of the liner 48 providing a seamless front face for the cabinet 12.

The spacers 56, frame 35 and breaker strip 22 retain the liner 48 in spaced relation to the outer wall 24 during an in-situ foam insulating process which takes place with the cabinet 12 facing upwardly.

The foam also passes through the apertures 58 of the spacers 56 to fill the area between the breaker strip 22, the frame 35 and the spacers 56. After the insulating process the cabinet 12 is fixedly secured by the spacers 56 tying the liner 48 to the frame 35, and by the foam 84 adhering to the liner 48 and the fingers 81 of the breaker strip 22. A seal 86 of, for example, closed cell foam, is disposed between the front portion 66 of the breaker strip 22 and the front portion 36 of the frame 35 to serve as a foam stop.

If necessary, heating elements (not shown) may be disposed in the space 88 defined by the front portion 66, the outer turned portion 82 and the hook member 70 of the breaker strip 22 and the front portion 36 of the frame 35 to prevent condensation from building up along the front face 68 of the breaker strip 22.

The door 18 includes a rubber gasket 90 having an elongate magnet 92 disposed therein. The magnet 92 has an odd number of poles of alternating polarity, opposite the poles at the other magnet 41. By using magnets of opposite polarity it is not possible to install a magnet backward which would have the effect of attempting to align like poles. When the door 18 is in a closed position, the magnets 92 and 41 are attracted to one another causing the gasket 90 to seat firmly against the front face 68 of the breaker strip 22 preventing air from flowing between the freezer compartment 14 and the outside.

As previously discussed, the refrigerator/freezer 10 is a built-in unit. Such a unit may have cabinetry built around it so that its outer walls are not exposed. Alternatively, a decorative end piece 94 of, for example, stainless steel or aluminum, is secured by any known means to the outer wall 24. An insert 96 is secured to the end piece 94. The insert 96 may be of wood or laminate construction designed to match existing cabinetry.

Figure 3:
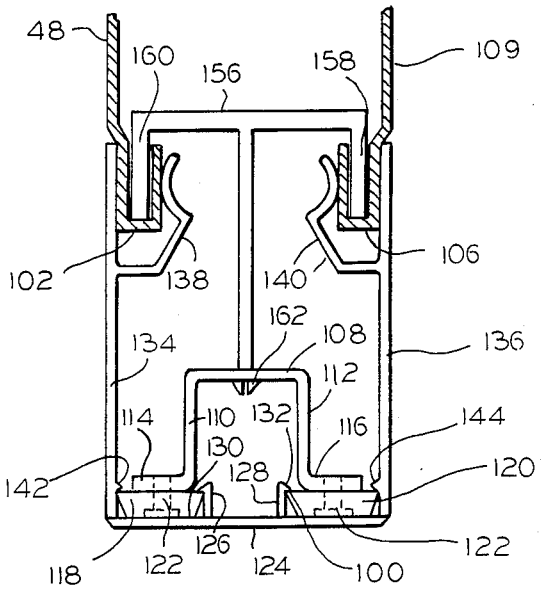
FIG. 3 is a partial sectional view taken, with the doors removed, along lines 3—3 of FIG. 1.

In a refrigerator/freezer unit, an additional inner resinous plastic breaker strip portion 100 is provided for the divider wall between the freezer compartment 14 and the refrigerator compartment 16. Each said compartment 14, 16 includes a liner of similar shape. The breaker strip 100 is illustrated in FIG. 3.

The freezer compartment liner 48 includes an innermost front edge channel portion 102 similar to the front edge channel portion 52 previously discussed with reference to FIG. 2. Similarly, a liner 104 for the fresh food compartment 16 is in juxtaposed relation with the freezer liner 48 and includes an inner front edge channel portion 106. A channel frame portion 108 having forwardly extending sidewalls 110, 112 and outwardly extending front walls 114, 116 extend between the frame sections (not shown) for the top and bottom walls 28, 30. First and second elongated trapezoidal magnets 118, 120 are secured with, for example, screws 122 to the front portions 114, 116, respectively of the channel frame 108.

The breaker strip 100 extends between the two liners 48, 104 and includes a front portion 124 defining a front face of the divider wall disposed forwardly of the channel frame 108. A pair of hook members 126, 128 each having ridges 130, 132, respectively, extend rearwardly from the front portion of the breaker strip 100. The breaker strip 100 further includes first and second rearwardly extending turned portions 134, 136, each including a bifurcated end 138, 140, respectively, loosely and resiliently embracing each of the channel edge portions 102, 106 of the liners 48, 104. A spacer 156 of resinous plastic is T-shaped and includes forwardly extending turned portions 158 and 160 at each end of the T, which are loosely secured to the liner channel edges 102 and 106, respectively, to maintain the liners in spaced relation. A snap connector 162 at the lower leg of the T locks into an aperture in the channel frame 108 to also partially retain the liners in spaced relation. Each of the rearwardly extending turned portions 134, 136 includes an inwardly extending ridge 142, 144, respectively. The ridges 130, 142 coact with the magnet 118, while the ridges 132, 144 coact with the magnet 120 to retain the breaker strip 100 in association with the channel frame 108 to define a seamless front face for the divider wall at the cabinet 12. During the in-situ foaming process, previously discussed, the foam 84 fills the space between the lines 48 and 104 and the breaker strip portion 100.

Figure 4:
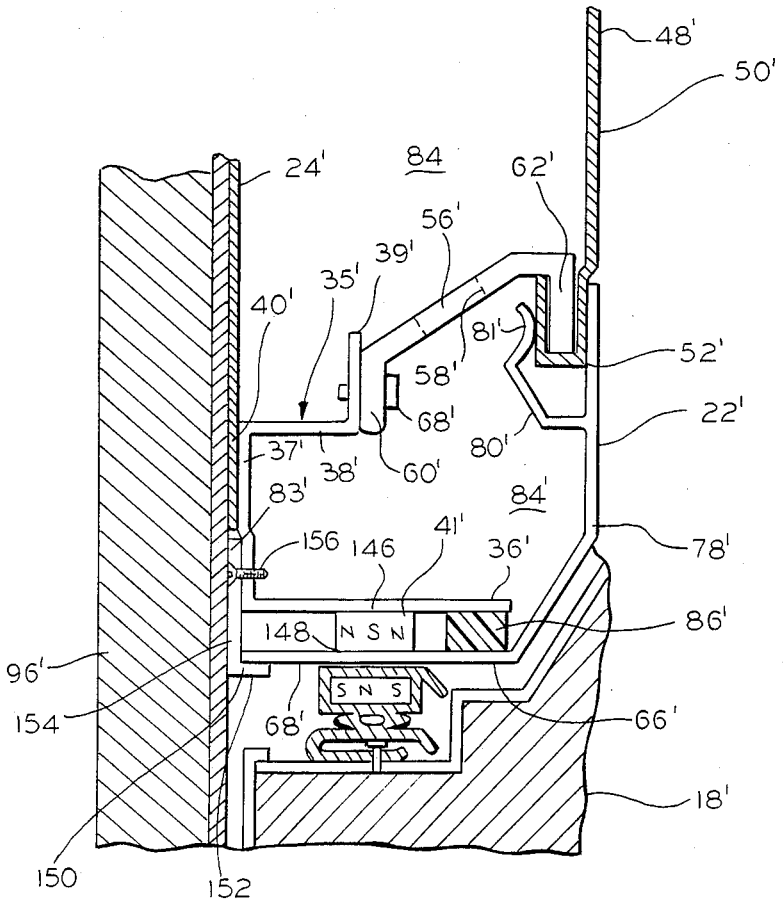
FIG. 4 is a sectional view similar to that of FIG. 2, or a modified form of the invention.

A breaker strip 22' for an alternate embodiment of the present invention is illustrated in FIG. 4 wherein primed reference numerals correspond to elements previously discussed with reference to FIG. 2. An elongated magnet 42' is of rectangular shape and is secured by, for example, an adhesive 42' to the front portion 36' of the metal frame 35'. The breaker strip 22' is made of a thermoformed plastic, and includes a front portion 66' defining a front face 68'. The front portion 66' is spaced outwardly from the front portion 36' of the frame 35'. The breaker strip front portion 66' is secured, for example, by a layer of adhesive 148 to the magnet 41' to secure the breaker strip 22' with respect to the frame 35'.

An angle member 150 of, for example, stainless steel includes a front portion 152 overlying a portion of the breaker strip front portion 68'. A side portion 154 of the angle member 150 is secured, for example, by screws 156 to the rearwardly turned side portion 37' of the channel frame 35'.

In all other respects the refrigerator cabinet construction including the breaker strip 22' is similar to that previously discussed with reference to FIG. 2. By utilizing the breaker strip 22' it is possible to thermoform the breaker strip 22' in a single piece construction to cover the entire front face periphery of the cabinet, and divider wall to provide seamless strips where each of the respect top, bottom, divider and side walls are joined together.

Thus, the invention broadly comprehends a breaker strip for a refrigerator cabinet which provides an aesthetically pleasing one-piece trim which acts as a nonmetallic door sealing surface which minimizes heat transfer and condensation.

The foregoing disclosure of the preferred embodiment is illustrative of the broad inventive concepts comprehended by the invention.

What is claimed is:

1. A refrigeration apparatus cabinet defining a front opening, said cabinet comprising:

an outer wall defining a front edge portion;

a liner within and spaced inwardly from said outer wall;

a body of in-situ formed insulation disposed in an insulation space between said outer wall and said liner;

a frame having a first surface portion secured to said front edge portion of said outer wall;

first securing means for securing said liner to a second surface portion of said frame to maintain said liner in spaced relation with said outer wall; and a resinous plastic breaker strip disposed between said front edge portion of said outer wall and said liner, said breaker strip comprising a generally U-section element including (a) a front portion defining a front face of said cabinet and spaced outwardly from a third surface portion of said frame, said front portion having an outer rearwardly extending portion aligned with and disposed forwardly of said front edge portion of said outer wall, (b) a rearwardly extending inner turned portion, (c) second securing means for securing said inner turned portion to said liner, and (d) third securing means for securing said breaker strip front portion to said frame in forwardly spaced relationship thereto, thereby defining a space between said front face of the breaker strip and said frame to prevent moisture condensation on the frame, said front face of said breaker strip defining a seamless front face for said cabinet.

2. A cabinet according to claim 1 further including an elongated magnet disposed in said space between said breaker strip front portion and said third surface portion of said frame.

3. The cabinet according to claim 2 further including a door selectively closing said cabinet opening, said door having a second elongated magnet wherein said elongated magnets are superimposed when said door is closed and each magnet having an odd number of alternating poles across a cross section thereof, the poles on said first elongated magnet being of opposite polarity to the poles of said second elongated magnet to provide seal between the door and the cabinet.

4. A refrigeration apparatus cabinet defining a front opening, said cabinet comprising:

an outer wall defining a front edge portion;

a liner within and spaced inwardly from said outer wall;

a body of in-situ formed insulation disposed in an insulation space between said outer wall and said liner;

a frame having a first surface portion secured to said front edge portion of said outer wall;

first securing means for securing said liner to a second surface portion of said frame to maintain said liner in spaced relation with said outer wall;

a resinous plastic breaker strip disposed between said front edge portion of said outer wall and said liner, said breaker strip including (a) a front portion defining a front face of said cabinet and spaced outwardly from a third surface portion of said frame, wherein said front portion is disposed forwardly of said front edge portion of said outer wall;

(b) a rearwardly extending inner turned portion, (c) second securing means for securing said inner turned portion to said liner, and (d) third securing means for securing said breaker strip front portion to said frame, said breaker strip providing a seamless front face for said cabinet, and a magnet disposed between said breaker strip front portion and said third surface portion of said frame, said magnet being secured to said breaker strip front portion by rearwardly extending hook members which latch with said magnet, said magnet being secured to said support frame third surface portion for securing said breaker strip to said frame.

5. A built-in refrigeration apparatus cabinet defining a front opening, said cabinet comprising:

an outer shell defining a front edge portion;

an interior liner within and spaced inwardly from said outer shell, said liner defining a front channel portion;

a layer of in-situ formed insulation disposed in an insulation space between said outer shell and said liner;

a support frame having a first surface portion secured to said front edge portion of said outer shell;

a spacer having a first edge secured to a second surface portion of said frame and a second edge loosely received in said inner channel portion to retain said liner in spaced relation with said outer shell;

a resinous plastic breaker strip extending between said front edge portion of said outer shell and said liner, said breaker strip comprising a generally U-section element including (a) a front portion defining a front face of said cabinet and spaced outwardly from a third surface portion of said support frame, (b) a rearwardly extending inner turned portion and a rearwardly extending outer turned portion aligned with and disposed forwardly of said front edge portion of the shell, (c) first securing means for loosely securing said inner turned portion to said liner adjacent said channel portion, and (d) finger means extending into the insulation space adjacent said liner channel portion; and second securing means for securing said breaker strip front portion to said frame in forwardly spaced relationship thereto, thereby defining a space between said front face of the breaker strip and said frame to prevent moisture condensation on the frame, said liner being partially retained in spaced relation to said outer shell by said spacer and said breaker strip and partially retained in said relationship by said in-situ formed insulation engaging said liner and said breaker strip, said breaker strip providing a seamless front face for said cabinet.

6. A cabinet according to claim 5 further including an elongated magnet disposed in said space between said breaker strip front portion and said support frame third surface portion.

7. The cabinet according to claim 6 further including a door selectively closing said cabinet opening, said door having a second elongated magnet wherein said elongated magnets are superimposed when said door is closed and each magnet having an odd number of alternating poles across a cross section thereof, the poles on said first elongated magnet being of opposite polarity to the poles of said second elongated magnet to provide a seal between the door and the cabinet.

8. The cabinet according to claim 6 wherein said second securing means comprises an angle member overyling a portion of said breaker strip front portion and further wherein said magnet is secured to said breaker strip front portion by adhesive.

9. The cabinet according to claim 5 wherein said first securing means comprises a bifurcated end portion of said inner turned portion which resiliently embraces a front edge of said liner.

10. The cabinet divider wall according to claim 5 further comprising a decorative sidewall affixed to said outer shell.

11. The cabinet divider wall according to claim 10 further comprising a decorative insert secured to said sidewall to provide a customized built-in refrigerator cabinet.

12. A built-in refrigeration apparatus cabinet defining a front opening, said cabinet comprising:

an outer shell defining a front edge portion;

an interior liner within and spaced inwardly from said outer shell, said liner defining a front channel portion;

a layer of in-situ formed insulation disposed in an insulation space between said outer shell and said liner;

a support frame having a first surface portion secured to said front edge portion of said outer shell;

a spacer having a first edge secured to a second surface portion of said frame and a second edge loosely received in said liner channel portion to retain said liner in spaced relation with said outer shell;

a resinous plastic breaker strip extending between said front edge portion of said outer shell and said liner, said breaker strip including (a) a front portion defining a front face of said cabinet and spaced outwardly from a third surface portion of said support frame, (b) a rearwardly extending inner turned portion and a rearwardly extending outer turned portion, (c) first securing means for loosely securing said inner turned portion to said liner adjacent said channel portion, and (d) finger means extending into the insulation space adjacent said liner channel portion;

second securing means for securing said breaker strip front portion to said frame, said liner being partially retained in spaced relation to said outer shell by said spacer and said breaker strip and partially retained in said relationship by said in-situ formed insulation engaging said liner and said breaker strip and further wherein said breaker strip provides a seamless front face for said cabinet, and an elongated magnet disposed between said breaker strip front portion and said support frame third surface portion, said magnet being secured to said breaker strip front portion by rearwardly extending hook members which latch with said magnet, said magnet being secured to said support frame third surface portion for securing said breaker strip to said frame.

13. In a cabinet divider wall having a first liner defining an inner front edge, and a second liner in juxtaposed relation with said first liner defining a divider wall of said cabinet, said second liner defining an inner front edge portion adjacent and spaced from said inner front edge portion of said first liner, the improvement comprising a generally U-section inner breaker strip portion extending between said inner front edge portions of said first and second liners, said inner breaker strip portion comprising:

a front portion defining a front face of said divider wall;

a first rearwardly extending inner portion loosely secured to and aligned with said inner front edge of said first liner;

a second rearwardly extending inner portion loosely secured to and aligned with said inner front edge of said second liner; and means for securing said inner breaker strip to said divider wall with said front face being spaced forwardly of said divider wall to define a space between said front face of he breaker strip and said frame to prevent moisture condensation on the frame, said inner breaker strip providing a seamless front face for said divider wall.

14. The cabinet divider wall according to claim 13 further including a support frame portion spaced rearwardly from said inner breaker strip portion front face and an elongated magnet disposed between said inner breaker strip front portion and said support frame portion.

15. The cabinet divider wall according to claim 14 further including an additional elongated magnet disposed between said inner breaker strip front portion and said support frame portion in spaced parallel relation with said other elongated magnet.

16. The cabinet according to claim 15 further comprising a decorative insert secured to said sidewall to provide a customized built-in refrigerator cabinet.

17. The breaker strip according to claim 15 further comprising a magnet secured to said frame wherein said hook members are latched to ridges of said magnet.

18. In a refrigerator/freezer cabinet defining a front opening, and having an outer shell defining a front marginal edge, an interior liner disposed within and spaced inwardly from said shell, said liner defining a front channel portion, with a body of in-situ formed insulation disposed between said shell and said liner for partially maintaining said shell and said liner, a frame structure having first surface portion secured to and extending forwardly from said front edge portion of said shell, and a plurality of spacers secured to a second surface portion of said frame and loosely secured to said liner channel portion for partially maintaining said liner in spaced relation with said outer shell, a resinous plastic breaker strip extending between said front edge portion of said outer shell and said liner, said breaker strip comprising:

a front portion defining a front face of said cabinet and spaced outwardly from a third surface portion of said support frame;

a plurality of hook members extending rearwardly of said front portion mechanically linked with said third surface portion of frame to secure said breaker strip to said frame;

a rearwardly extending inner turned portion having a bifurcated end resiliently embracing said liner adjacent said channel portion; and a rearwardly extending outer turned portion having a distal edge disposed forwardly of said front marginal edge of said outer shell, wherein said breaker strip provides a seamless front face for said cabinet.

* * * * *